United States Patent [19]

Amthor, Jr.

[11] 4,173,872

[45] Nov. 13, 1979

[54] WATER HEATER APPARATUS

[75] Inventor: Franklin R. Amthor, Jr., Murrysville, Pa.

[73] Assignee: Energy Utilization Systems, Inc., Pittsburgh, Pa.

[21] Appl. No.: 874,328

[22] Filed: Feb. 1, 1978

[51] Int. Cl.[2] ..... F25B 27/02

[52] U.S. Cl. ..... 62/238

[58] Field of Search ..... 62/331, 238 A, 238 B, 62/238 C, 238 D, 238 E, 238 R; 165/137; 219/279; 122/32

[56] References Cited

U.S. PATENT DOCUMENTS

| | | | |
|---|---|---|---|
| 2,125,842 | 8/1938 | Eggleston | 62/238 E |
| 2,375,157 | 5/1945 | Wilkes et al. | 62/238 E |
| 2,516,094 | 7/1950 | Ruff | 62/238 E |
| 2,575,325 | 11/1951 | Ambrose et al. | 62/238 E |
| 2,632,306 | 3/1953 | Ruff | 62/238 E |
| 2,696,085 | 12/1954 | Ruff | 62/238 E |
| 4,073,285 | 2/1978 | Wendel | 62/238 E |

FOREIGN PATENT DOCUMENTS

| | | | |
|---|---|---|---|
| 2540004 | 3/1977 | Fed. Rep. of Germany | 62/238 |

*Primary Examiner*—Lloyd L. King

*Attorney, Agent, or Firm*—Lloyd F. Engle, Jr.

[57] ABSTRACT

A water heater, converted from existing water heaters or in newly designed and manufactured water heaters, having a condenser tube of a refrigeration unit in thermal conductive contact but not intimate contact with the water to be heated, and having a sheath tube in conjunction with and outwardly disposed to the said condenser tube, and having the inter-space or inter-spaces between the said condenser tube and the said sheath tube filled with thermal conductive material, said inter-space being open or fragilely rupturable to the outside of the water heater.

18 Claims, 17 Drawing Figures

WATER HEATER APPARATUS

BACKGROUND OF THE INVENTION

Residential water heaters, presently in use and being manufactured, comprise basically two types; i.e., the electric $I^2R$ (resistance) type and the gas flame type. Both of these types are extremely inefficient in light of present concerns for energy shortages and conservation. While this invention also relates to newly manufactured domestic water heaters, one of the difficult problems solved by this invention is the conversion of the millions of both types of hot water tanks which are now in service.

The purpose of this invention is to achieve a manufacturing design and conversion design which will effect a Coefficient of Performance (C.O.P) in excess of the existing conventional apparati and methods. In experimentation, utilization of this invention has attained a C.O.P. of three or more over the electric (resistance) means of heating.

In the conventional hot water tank or either type, the cold water supply enters at the top and is conducted by the inlet conduit to a discharge point near the bottom of the tank. The main heat source is at or near the bottom of the tank and the cold water introduced is there heated. The heated water rises, through convection, and is withdrawn at the top of the tank.

In the conventional electric water heater there are two resistance heating elements. The main element is inserted through a threaded or bolted plate orifice near the bottom of the tank. The secondary or auxiliary element is inserted through a similar orifice near the top of the side of the tank. One form of this invention replaces the main element and leaves the secondary or auxiliary element undisturbed to function in its present capacity. Another form of this invention replaces one or both elements and accomplishes the heating of the water outside of the tank. This latter form is also especially useful in the conversion of gas flame heaters, because the only tank entry near the bottom is the drain port which provides available entry of only about ¾" diameter. However, this latter form is also useful for the conversion of gas flame and electric water heaters by entry through the orifice provided in or near the top of the tank for the T & P valve by employing a long extension, terminating near the bottom of the tank, for offtake of the cold water.

In the conventional gas flame water heater, the main heat source is a gas burner mounted below the bottom of the tank and the secondary heat source is the centrally located flue through which the hot combustion gases ascend, imparting residual heat to the surrounding water and exiting at the top of the tank to be exhausted through the chimney flue. Since there is no need to exhaust combustion gases with the use of this invention, both heat sources may be replaced and the external connection to the chimney flue eliminated.

In both types of conventional water heaters lining material of considerable fragility, such as glass, is incorporated. Accordingly, in any conversion of heat source, it is important to utilize existing openings and avoid cutting new openings in the tank. However, this limitation does not pertain in the application of this invention to newly manufactured water heaters.

This invention relates to the apparati for replacing existing heat sources in existing and newly manufactured water heaters and the method for installing same in water heaters which are presently in use. The apparati basically comprises unique forms of the condenser tubing side of a standard refrigeration or air conditioning unit and the method is comprised in the manner in which the apparati are installed in replacement of or in substitution for the present conventional heat sources in water heaters. Since manufacturers of water heaters have large investments in design, tooling and production methods for the water heaters which are presently manufactured and marketed, this invention possesses utility in water heaters to be manufactured in the future, according to the present designs as well as those which are already in use, and also possesses utility in newly designed and manufactured water heaters, wherein more appropriate orifices may be provided to accomodate the entry and installation of the condenser tubing heating element.

In the present utilization of refrigeration and air conditioning units, the heat which is generated by the compressor and the condenser tubing is wastefully dissipated and its dissipation sometimes requires inconvenient of difficult installations. This invention provides a convenient, economic and useful means for the dissipation of that heat.

In all forms of this invention, the condenser tubing containing the hot refrigerant fluid, such as Freon, is in thermal conductive, but not intimate, contact with the water to be heated in the tank. The lack of intimate contact is intentionally maintained in order that the potable integrity of the water will not be violated by a potential failure of the condenser tubing and the resultant escape of refrigerant into the water in the tank. While it is not believed that all present regulations specifically require these safeguards, such will be promulgated, certainly. Accordingly, in the embodiments of this invention wherein the apparati are inserted directly into the water inside the heating tank and wherein the water is withdrawn from the tank and heated and reintroduced, the condenser tubing is surrounded by a sheath of corrosion resistant, thermal conductive material which is metallurgically compatible with the condenser tubing and which is outwardly disposed from and in uniform or intermittently variable spaced relation to the outside diameter of the condenser tubing. The inter-space or inter-spaces therebetween is filled with thermal conductive material, such as copper, aluminum, carbon, graphite, F.D.A. approved silicone, and the like, in powdered or finely particulate form or jelled or fluid state, or, alternatively, thermal conductive liquids, such as water, mineral oil and the like, or combinations of both types. However, in experimentation, it has been found that the use of water to fill the inter-space is effecient, safe, and convenient. External termini of the interspace are open or fragilely rupturable on the outside of the tank, in order that escape of the refrigerant be provided in the event of any failure of the condenser tubing, and to provide a telltale in the event of any failure of the sheath. The same type of sheathed tubing is utilized in this invention for the embodiment wherein the water is conducted outside of the tank, heated and reintroduced into the tank.

In the sheathed condenser tubing of this invention, it is desirable to maintain the inter-space relatively uniform between the outside of the condenser tubing and the inside of the sheath to insure reasonable uniformity in distribution of the thermally conductive material introduced therein while providing thermal conductive space preserving means to maintain optimum provision of heat transfer. For this purpose, a number of different embodiments of condenser tube and sheath design are incorporated in this invention. One such embodiment is comprised in spacer fins attached to the condenser tubing and extending radially outward therefrom to slidable contact with the inside of the sheath. Another such embodiment is comprised in reverse of the foregoing, with the fins attached to the inside of the sheath and extending radially inward therefrom to slidable engagement with the outside of the condenser tubing. Alternatively, advanced extrusion techniques permit the manufacture of the complete sheathed tubing with spacer fins fixedly engaging the inside of the sheath and the outside of the condenser tubing. Still another such embodiment is comprised in intermittently crimping the sheath bilaterally into contact with the condenser tubing. Still another such embodiment is comprised in providing longitudinal or helical corrugations in either the condenser tubing or the sheath or both. It will be seen that other forms and combinations may be utilized, the important considerations being provisions of good thermal conductivity from the hot condensed refrigerant to the sheath and preservation of the potable integrity of the water.

The conventional operation of the standard refrigeration unit which is used in this invention comprises delivery of the refrigerant from the compressor to the condenser, passage though a drier and capillary expander, or other expansion device, vaporized passage through the cooling coils or evaporator, and back to the compressor. All of this operation is well known in the prior art and, excepting for the condenser, are not shown other than by general outline or discussed with particularity.

In the application of this invention to electric water heaters wherein entry of the condenser tubing and sheath is effected through the port which has accommodated the lower heating element, the form of a cylindrical helix or truncated conical helix is used. While the truncated conical form of helix permits the initially entering coils of the truncated end to be closer together, experimentation has disclosed that it does not result in placing any greater length of condenser tubing and sheath inside the tank than the cylindrical form of helix and is slightly more difficult to form. As explained hereinafter, it will be seen that the diameter of the helix, the distance between the coils, and the inside diameter of the water tank are all critically related considerations. The insertion of approximately eleven feet linear length of condenser tubing and sheath into the tank is adequate and has been accomplished through this invention. Of course, after the initially entered end of the helix contacts the opposite side of the tank, some compression or diminution of the space between the coils can be accomplished, thereby permitting the entry of some additional coiled tubing and sheath, but such compression of the helix is limited by reason of possible detrimental deformation and, perhaps, rupture of the condenser tubing or sheath or both. For consideration in fabrication of the cylindrical helix form, the entry limitation formula desirably requires that the dimension between adjacent coils be not less than one-half the outside diameter of the helix.

In older electric water heaters, the entry port for the resistance heating element is comprised in a bolt-on plate, while the newer models provide a threaded flange attached to the inside of the tank. In either case, the opening available for insertion of the helically coiled condenser tubing and sheath is in the nature of 1¼ inches in diameter. The entry is accomplished by inserting the leading end of the tubing and sheath into the tank port and causing rotation of the helix proximately around its longitudinal axis while keeping the helix in such position that the portion passing through the tank port is at the largest possible angle from the longitudinal axis of the port as is permitted by the dimensions of the cooperating elements. In this regard, it will be seen, as shown herein, that it is most advantageous that the major axis of a cross section of the condenser tubing and sheath be proximately perpendicular to the longitudinal axis of the helix. Desirably, for maximum insertion and minimum space between coils, the outer end of the major axis of the cross-section of the condenser tubing and sheath is canted toward the leading end of the helix. Obviously, in the embodiment of this invention wherein the water is withdrawn from the tank, heated and reintroduced, these critical dimension considerations do not exist.

In operation of the standard refrigerating unit utilized in this invention, the refrigerant is delivered from the compressor to the condenser at a range of approximately 140°-180° F., thereby providing an adequate heat source for heating the water to the customary temperature of 140°-160° F. Clearly, the refrigerant cools to a lesser temperature as it passes through the condenser, which is one of the purposes of the condenser in the refrigeration process. Since it is necessary, in this invention, that the refrigerant be carried by the sheathed condenser tubing both into and out of the tank, there must be a continuous inlet and outlet condenser tube and a continuous sheath, which sheath must be open or fragilely rupturable to the outside of the tank. It is not possible to make a sufficiently sharp return bend of 180° at the leading or entry end of the helix without restrictively crimping the thin copper tubing used in the condenser tubing and the sheath. Therefore, this invention incorporates unique return caps for each, which are braised or soldered in place prior to insertion. It will be seen that the outlet condenser tube will be progressively cooler from the return point to exit from the tank and the inlet condenser tube will be progressively hotter from the return point to entry into the tank. While it is not necessary, it is possible to provide insulation between them when they are enclosed in a single sheath. Of course, in the embodiment wherein they are separately sheathed, there is no need that they be in attached contact. Heat transfer from the sheath to the water may be increased by the addition of thin radial thermal conductive fins attached in thermal conductive manner, such as soldering, to the sheath. While such fins cause some difficulty, and may be deformed, in the insertion procedure, such deformation is unimportant, since they continue to present additional heat transfer surface, even in deformed state. It is important, however, that such fins be provided on the sheath only at positions where they will be aligned proximately parallel with the convection flow of the water being heated. Otherwise, I have found that they will impede the convection flow, which is undesireable.

In the application of this invention to newly designed and manufactured water heaters, it is preferred to mount the compressor and evaporator of the refrigerating unit on top of the tank, as I have done also in some of the conversion applications of this invention. This arrangement conserves floor space and utilize space for the refrigerating apparatus which, ordinarily, is not used in the usual installation of a water heater. More important, however, I have found that the slight vibration which is imparted to the tank by the compressor greatly enhances the convection and resultant heating of the water. Also the heat imparted to the compresser from the warm tank prevents the accumulation of liquid refrigerant in the compressor and resultant slugging thereof. In such arrangement, for newly designed water heaters, the location and space limitation of an existing orifice for insertion of the sheathed condenser tubing into the tank is not pertinent, since an orifice which is appropriate in size and location is provided. In one such embodiment of this invention, the combined condenser inlet and outlet tubing enters through a provided orifice in the top of the water heater, along with the sheathing, and extends proximately to the bottom of the tank where it terminates in a helical coil or spiral. In another such embodiment of this invention, the combined condenser inlet and outlet tubing extends down the outside of the water heater, adequately insulated and encased, and enters through a provided orifice in the side of the tank proximate the bottom, along with the sheathing, and terminates in a helical coil or a multiplicity of bends.

A very efficient form of the invention in newly designed and manufactured water heaters is obtained by providing a vertical convection conduit or chimney positioned vertically in the tank and being approximately four (4) inches in diameter. This conduit may be attached to the top of the tank or the bolt plate through which the sheathed condenser tubing enters and exits, having its upper portion, in the nature of the top twelve (12) inches, pierced, and have its lowermost end disposed proximately above the bottom of the tank. Or, conversely, may be attached to the bottom of the tank, having its lower portion pierced, and have its uppermost end disposed proximately below the top of the tank. The sheathed condenser tubing is inserted inside this conduit and may be either the type which has a helical coil near its bottom extremity with a straight upward return therefrom, or the type which merely accomplishes four (4) or more vertical runs inside the conduit. The conduit is made of plastic tubing or other non-corrosive material, since its thermal conductivity is not important, and it is sufficiently large in diameter to permit a complete return bend of the sheathed condenser tubing without crimping, which requires about three (3) inches. In this embodiment of the invention, the convection commences with the cooler water near the bottom of the tank being heated by the sheathed condenser tubing inside and near the bottom of the conduit, rising much more rapidly than it would in the larger volume of the entire tank, exiting from the top of the conduit, and flowing downward as it cools or mixes with cooler water in the relatively much larger volume of that portion outside of the conduit. In addition, this design assures a concentrated flow of the hotest water to the upper portion of the tank, at the point of hot water take-off.

An adaptation of the immediately preceding described embodiment is also conveniently used in the conversion of existing gas flame water heaters. In this concept the outer flue, which is an extension of the concentric longitudinal internal flue, is removed because it is no longer needed. The lowermost end of the internal flue is plugged or capped, so that the flue is watertight and the gas burner beneath the bottom of the tank is removed and discarded. The sheathed condenser tubing, of one of the types hereinbefore described as being inside the convection conduit, is inserted downward into the internal flue, the flue is filled with thermal conductive material in powdered or particulate form, or with liquid such as water, and the top of the internal flue is left open or sealed with fragilely rupturable material. It will be seen, in this conversion concept that the sheath surrounding the condenser tubing could be eliminated and ordinary condenser tubing used, since the internal flue acts as a sheath. However, I do not recommend that as being safe and still prefer to use sheathed tubing for insertion into the flue, because many internal flues are badly corroded from combustion gases, and the internal flue may fail.

SUMMARY OF THE INVENTION

This invention of a water heater source includes a sheathed tube heating coil which is inserted into the water tank through an appropriate port of the conventional existing hot water tanks or through a provided orifice in newly designed tanks. The inlet portion of the inner tubing is connected to the compressor side of a conventional refrigeration or air conditioning unit and the outlet side is connected to the cooling coil or evaporator side of same. The outside end or ends of the continous sheath is open or fragilely rupturable outside the water tank and the water in the tank is in intimate contact with the sheath. The inter-space between the condenser tube and the sheath is filled with thermal conductive material having a relatively high coefficient of conduction, and fins or corrugations communicate between the outside of the condenser tubing and the inside of the sheath to maintain the inter-space and provide additional conductivity. The sheath and outward venting of the space between the sheath and refrigerant tubing protects the potable integrity of the water. In the conversion of existing electric water heaters, the major portion of the sheathed inlet and return condenser tubing which is inserted into the tank is formed into a cylindrical or truncated conical helix and is rotated about its longitudinal axis, thereby being screwed into the tank through the lower electrical heating element port. A special sealing means is provided to surround the sheathed tube and close the port.

In the application of my invention to newly designed and manufactured water heaters, the sheathed inlet and return condenser tubing is inserted through conveniently provided orifices.

In another embodiment of this invention, for either converted or new heaters, water is withdrawn from a port, heated by contact with a similar sheathed tube condenser coil and returned to the tank.

DESCRIPTION OF THE PREFERRED EMBODIMENT

Figure 1:
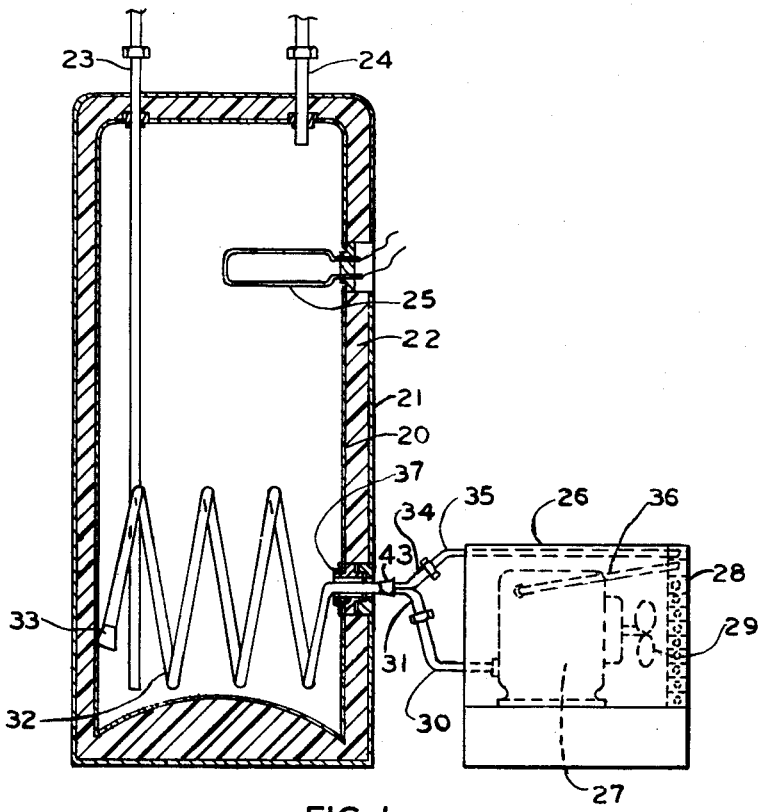
FIG. 1 is a vertical cross-sectional view of an existing electric water heater with heat source converted according to the invention.

The first embodiment of the invention for conversion of the present form of electric $I^2R$ (resistance) water heaters will be described with reference to FIG. 1.

This present form of water heater has an inner tank shell 20, usually of steel with an inner lining of corrosion resistent material, such as glass, an outer case 21, insulating material 22 therebetween, a cold water inlet 23 entering the top of the tank and extending downward therein to terminate proximate the bottom of the tank, and a hot water offtake 24 entering the top of the tank. This arrangement of components is typical in virtually all water heaters, whether existing, newly manufactured, electric resistance, or gas flame, and it will be seen that each of the drawings, FIGS. 1 through 8, incorporate these components.

The existing upper or auxilliary electric heating element 25 may remain in the water heater. A conventional refrigeration unit 26, well known in the art and comprising a compressor 27, an evaporator 28, and a fan 29, feeds hot refrigerant from the compressor 27 through tube 30 to the inlet tube 31 prior to tube 31 entering the sheath of my sheathed condenser coil 32 which is in the form of a helix screwed into the tank through the port from which the lower electric heating element has been removed and the port closed by the coupling assembly shown in FIG. 10. The hot refrigerant passes through the inlet condenser tube 31 inside the sheath until it reaches the condenser tubing and sheath return cap 33 (FIGS. 14 and 15) where it is turned into the outlet condenser tube 34 which remains sheathed until after leaving the tank through the said coupling assembly. From the outlet condenser tube 34, the refrigerant is conducted by tube 35 to the evaporator 28 and then back to the compressor 27 by the tube 36. Inlet tube 31 and outlet tube 34 are coupled to tubes 30 and 35 respectively outside the water heater tank and beyond the outer extremity of the sheath by standard screw type tubing couplers well known in the art.

The water to be heated makes initial entry into the tank through inlet 23, comes in contact with the hot sheathed condenser coil 32 and/or other water already heated thereby, is heated and rises by convection to be taken for use through offtake 24. When hot water is not being drawn and, correspondingly, cold water not being introduced, the desired water temperature is maintained by periodic operation of the compressor 27 as needed and is controlled through a conventional type thermostat connected to the energization means for compressor 27 so as to cause it to operate whenever the water temperaure drops to the lower limit of the selected temperature range.

Figure 9:
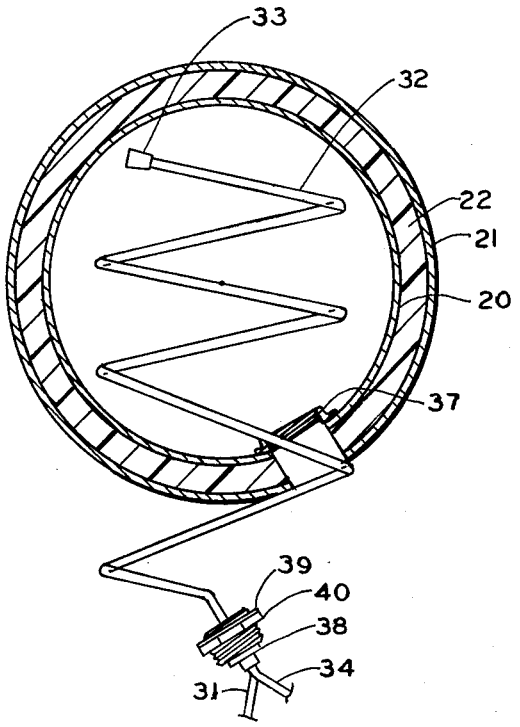
FIG. 9 is a cross-sectional plan view showing the cylindrical helix of sheathed condenser coil partially inserted into the tank in conversion of existing electric water heaters according to the invention.

Referring to FIG. 9, the electric resistance heating element has been removed from the existing lower port 37 which has internal existing threads. Prior to insertion of the helical sheathed condenser coil 32, into the tank through port 37, beveled collar 38 of metal compatible with the sheath material is continuously soldered to the outside of the sheath around the inner aperture of the beveled collar 38 at a predetermined position proximately forward of the outermost extremity of the sheath, after having placed gasket 39 and male coupling nipple 40 around the sheath and forward of beveled collar 38 in that order for use in completing the closure after insertion of helical sheathed condenser coil 32. The outer circumference of beveled collar 38 is circular and the forward bevel cooperatively corresponds to the internal bevel on the outer end of male coupling nipple 40. However, the inner aperture of beveled collar 38 has configuration corresponding to the outer surface of the sheath. Also, prior to insertion of helical sheathed condenser coil 32 into the tank, the inter-spaces between the sheath and the condenser tubing 31 and 34 is filled with thermal conductive material and said inter-spaces are sealed at the outermost extremity of the sheath with fragilely rupturable mastic or membrance 41. I have found that water is a convenient, effective and safe thermal conductive material for filling the inter-spaces.

With the components in place as aforesaid, insertion of my helical sheathed condenser coil 32 is accomplished by passing the leading end, with my return cap 33 in place, through port 37 and rotating the helical sheathed condenser coil 32 proximately about its longitudinal axis, thereby screwing the sheathed coil 32 into the tank. In so doing, and especially by direct thrust after reaching the straight section of the sheath and condenser tubing, a certain longitudinal compression of the helix may be accomplished without detrimental effect. Male coupling nipple 40 is then screwed into port 37, compressing gasket 39 against the tank, and closure cap 42 is slid over the assembly and screwed onto the outwardly disposed threads of male nipple 40, drawing beveled collar 38 into sealing engagement with the internal bevel of nipple 40. Inlet condenser tube 31 is then coupled to tube 30 coming from compressor 27, outlet condenser tube 34 is coupled to tube 35 leading to evaporator 28, and, after charging the system with refrigerant, it is ready for operation.

Figure 10:
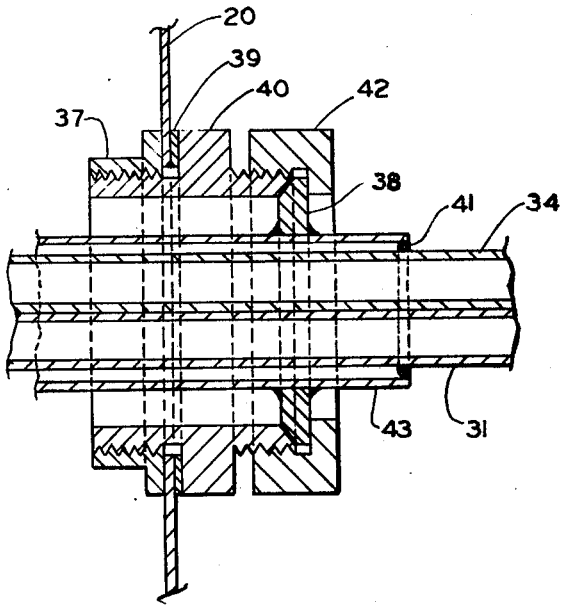
FIG. 10 is an enlarged cross-section of the coupling assembly surrounding the sheathed condenser tubing and closing the port in the conversion of existing electric water heaters according to the invention.

FIG. 10 shows the tank shell 20 with internally threaded port 37 and all of the closure elements, collar 38, gasket 39, coupling nipple 40, sealant 41, and cap 42, in place. Some of the present electric resistance water heaters have an external bolt plate rather than a threaded port. It will be obvious that adaptation of my closing assembly to that form may be accomplished by merely substituting a plate with corresponding bolt holes and external threaded male nipple for the coupling nipple 40 shown in FIG. 10.

Figure 11:
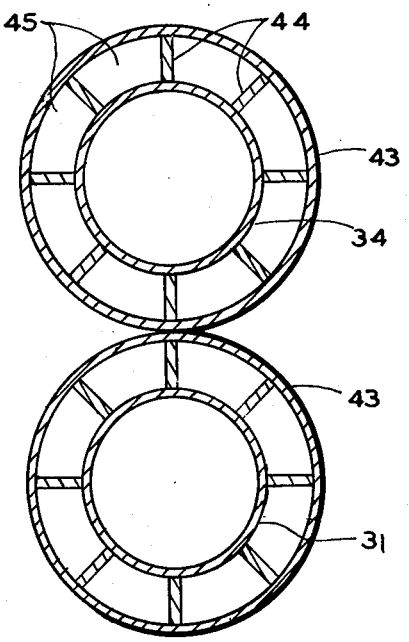
FIG. 11 is a cross-sectional view of one form of sheathed condenser tubing according to the invention.

FIG. 11 shows one form of my sheathed condenser tubing in cross-section, having separate sheaths 43 which come in intimate contact with the water to be heated, fins 44 which fixedly engage the inner surface of sheath 43 and the outer surface of condenser tubes 31 and 34, thereby creating inter-spaces 45 which are filled with thermal conductive material. Alternatively, fins 44 may fixedly engage the sheath and slidably engage the condenser tubes 31 and 34, or vice versa, to facilitate extrusion. The fins 44 serve a two-fold purpose, in that they maintain relatively uniform inter-spaces as well as forming positive thermal conductive paths between the condenser tubes 31 and 34 and the sheaths 43. At the tangential point between sheaths 43, they need not be attached and, in fact, greater ease in inserting the helical condenser coil 32 is achieved if they are not.

Figure 12:
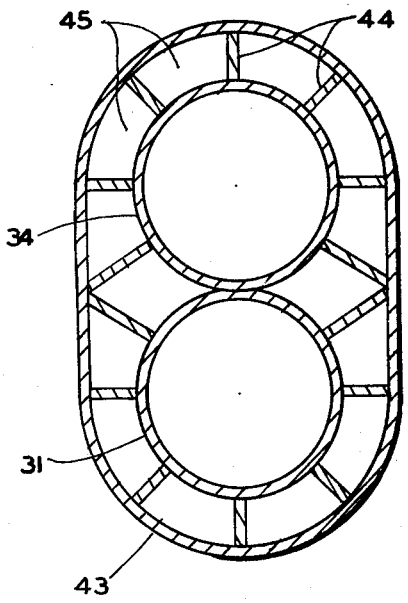
FIG. 12 is a cross-sectional view of another form of sheathed condenser tubing according to the invention.

FIG. 12 shows another form of my sheathed condenser tubing in cross-section and I find this form preferable to that shown in FIG. 11 because of the reduced dimension of the major axis, if the same diameter condenser tubing were used, which is critical in the matter of inserting the sheathed helical condenser coil into a tank through the existing lower heating element port. Obviously, if the dimension of the major axis of each form is made the same, that is, the maximum permitted by the size of the port, the form shown in FIG. 12 will incorporate larger diameter condenser tubes 31 and 34, thereby increasing its heat carrying capacity. Otherwise, in FIG. 12, the separate elements have the same features and perform the same functions as those described hereinbefore as to FIG. 11.

Figure 13:
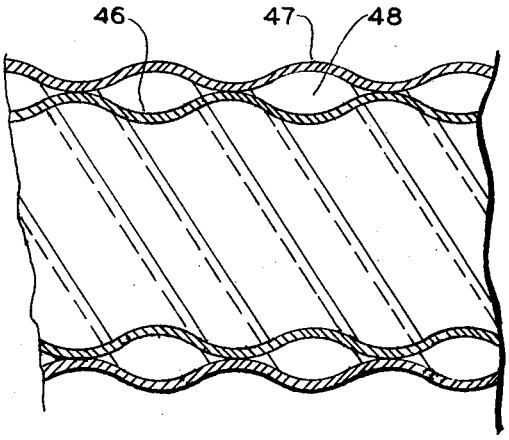
FIG. 13 is a longitudinal cross-section through another form of sheathed condenser tubing according to the invention.

FIG. 13 represents another form of my sheathed condenser tubing in longitudinal section comprising a condenser tube 46, which is corrugated in the form of a helix, and a sheath 47, which is also corrugated in the form of a helix. The condenser tube 46 is inserted in the sheath 47 so that the peaks of the corrugations of condenser tube 46 engage the valleys of the corrugations of sheath 47, thereby creating good continuous contact thermal conduction and a continuous helical inter-space 48, which is filled with thermal conductive material. The difficulty in obtaining flow of powdered or particulate thermal conductive material virtually dictates that liquid thermal conductive material be used with this form, and I have found water to be convenient, effective and safe in use with this form. Although FIG. 13 depicts only a single conduit of condenser tube 46 and sheath 48, it will be obvious that it may be arranged and used for both inlet and outlet sheathed condenser tubing, in arrangement similar to that shown in FIG. 11, for those conversion installations which require entry and exit through the same existing port. On the other hand, that is not a requirement for installation in newly designed and manufactured water heaters, wherein the entry point can be designed to accommodate the entry of inlet sheathed condenser tubing and the separate exit of outlet sheathed condenser tubing. These installations are discussed hereinafter as other embodiments of my invention. As will be obvious in those embodiments, the form shown in FIG. 13 and one-half of the form shown in FIG. 11 may be used for both the inlet and outlet condenser tubes with the return being accomplished through bends of the continuous sheathed tubing.

Figure 14:
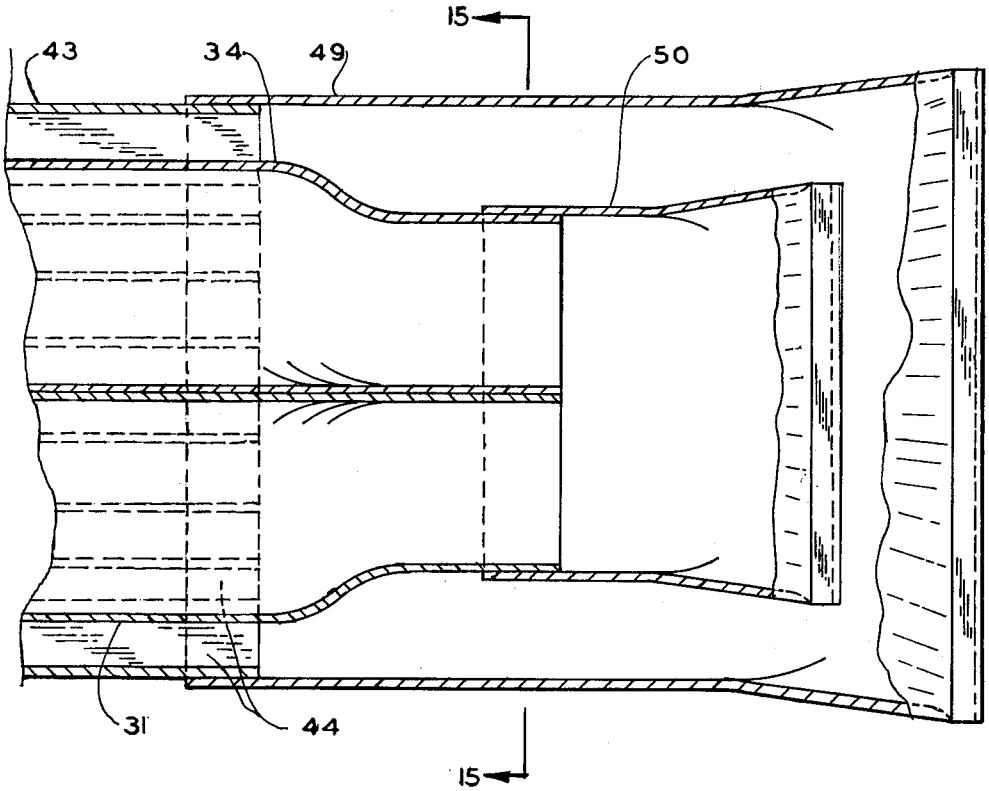
FIG. 14 is a partial longitudinal cross-section through and partial side view of the condenser tubing and sheath return cap at the insertion end of the helical coil inserted into the tank according to the invention.
Figure 15:
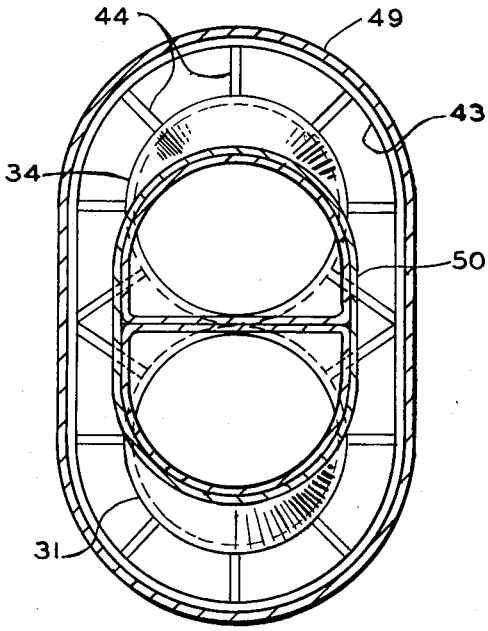
FIG. 15 is a cross-sectional view through the condenser tubing and sheath return cap shown in FIG. 14 and taken along plane 15—15 on FIG. 14.

FIGS. 14 and 15 show generally the condenser tubing and sheath return cap 33 which I use in those installations wherein the inlet condenser 31 and the outlet condenser tube 34 are enclosed in the same sheath and must be inserted, in the helical coil form, through the existing port. It has a sheath cap 49 which comprises a section of tubing having the same cross-sectional configuration as the sheath and being sufficiently larger to be placed in outwardly disposed slidable engagement with the sheath for a relatively short area of engagement and is continuously soldered to the sheath over the area of said engagement. The other end of sheath cap 49 is closed and sealed by crimping, in the nature of a fold type crimp, and can be soldered also to assure that it is water tight. My condenser tubing cap 50 is made in much the same fashion and form, but of smaller dimension, as my sheath cap 49. To prepare the end of my sheathed condenser tubing for the installation of my sheath cap 49 and my condenser tubing cap 50, a portion of the sheath 43 and fins 44 are cut back so that inlet condenser tube 31 and outlet condenser 34 protrude. Said protruding ends are then pressed together, in the nature of a controlled single-direction swaging, so that their common contact area is flattened and their combined cross-section assumes an oval form of substantially the same configuration as and slightly smaller dimensions than the condenser tubing cap 50. Thereupon, the condenser tubing cap 50 and the sheath cap 49 are slidably engaged over the ends of the inlet and outlet condenser tubes 31 and 34 and the end of sheath 43 respectively and soldered, in that order. Thereby, it will be seen that the sheath cover of the condenser tubing, with inter-space, and, accordingly, the potable integrity of the water in the tank are continuously preserved.

FIGS. 2, 3, 5, and 6, all show embodiments of my invention used with newly designed and manufactured water heaters, wherein the entry port for the sheathed condenser tubing is conveniently positioned and sized for admission of the configuration of coils or return bends of the sheathed condenser tubing selected. All of these embodiments incorporate the standard elements of an inner tank shell, 20, an outer case 21, insulating material 22 therebetween, a cold water inlet 23, and a hot water offtake 24. Also, all of these embodiments comprise the refrigeration unit 26 (not shown but identical in FIGS. 5 and 6) which is top mounted on the water heater tank and comprising the general components of a compressor 27, an evaporator 28, and fan 29. I have found this top mounting of the refrigeration unit very advantageous for the reasons explained hereinbefore and, in addition, this arrangement provides a unified commercial product. However, instead of the evaporator 28 being straight, as is customary in conventional units, I have bent the evaporator 28 at its mid-point, so that it fits within the circumferential limits of the water heater without protrusion.

Figure 2:
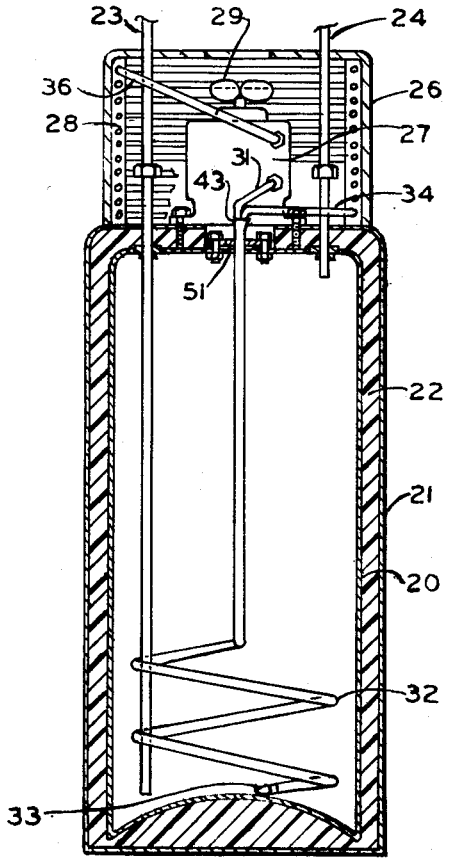
FIG. 2 is a vertical cross-sectional view showing a form of the invention for use as the heat source in newly manufactured water heaters.

In the embodiment shown in FIG. 2, my sheathed condenser coil 32, comprising inlet condenser tube 31, condenser tubing and sheath return cap 33, outlet condenser tube 34, sheath 43 and fins 44, is screwed through the port in the top of the tank and extended downward to a position proximate the bottom of the tank by provision of a long lead, or predetermined length, of the same constituency of sheathed condenser tubing. The port is then closed by securing bolt plate 51, soldered or brazed to sheath 43 and adapted to engage threaded studs on the tank and a sealing gasket. Sheath 43 terminates above bolt plate 51 and the inter-space termini are left open or fragilely sealed. Since this embodiment contemplates assembly in manufacture of the water heater, cold water inlet can be inserted after the sheathed condenser coil 32 is in place and pass inside the coil, thereby permitting the diameter of said coil 32 to be enlarged proximate the inside diameter of the tank.

Figure 3:
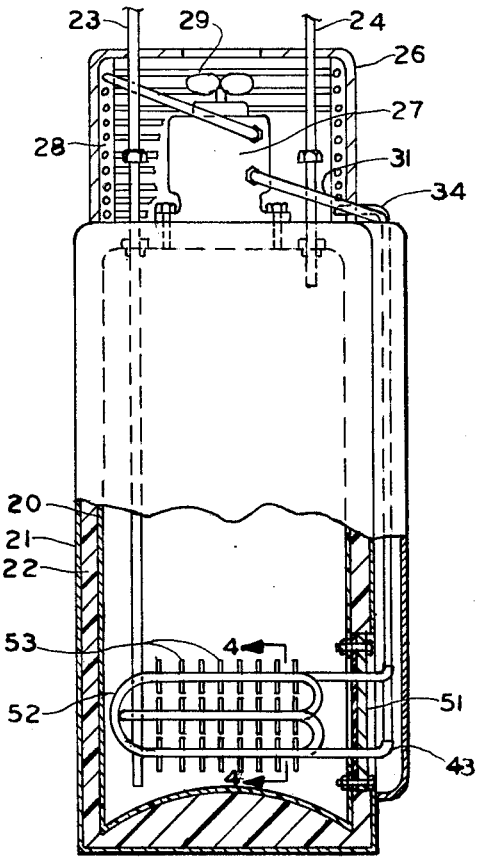
FIG. 3 is a partial vertical cross-section and partial side view of another form of the invention for use as the heat source in newly manufactured water heaters.
Figure 4:
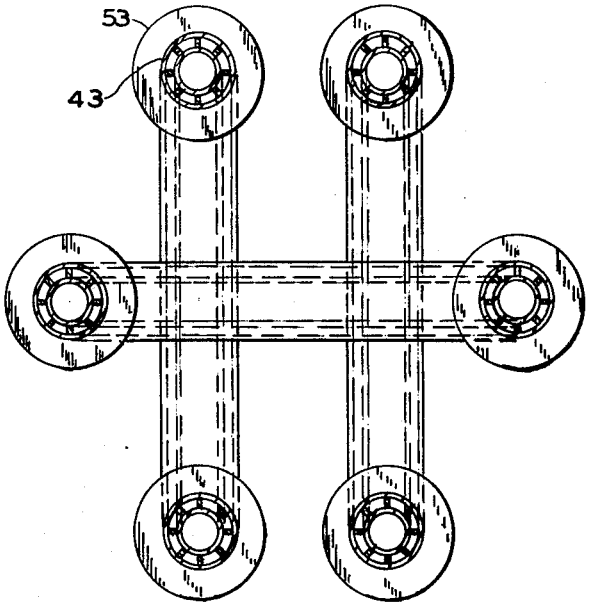
FIG. 4 is a cross-sectional view through the sheathed condenser tubing shown in FIG. 3 and taken along plane 4—4 on FIG. 3.

The embodiment shown in FIG. 3 has the port located in the side and proximate the bottom of the tank and utilizes a bolt plate 51 closure soldered or brazed to sheath 43 and a sealing gasket, similar to the closure means in FIG. 2. However, in this embodiment the sheathed heating unit 52, comprising continuous single sheathed condenser tubing, is arranged in a plurality of runs with reverse bends, the said runs and reverse bends having the elements comprised in one-half of the section shown in FIG. 11 or the same as shown in FIG. 13. I have also attached foil-like radial fins 53 to the outside of the sheath 43 on the runs, so that the planes of the fins 53 are vertical much like the usual fins on evaporator tubing, so as to increase heating area and not impede convection. The inlet condenser tubing 31 comes from the compressor 27 and extends down the outside of the tank, appropriately insulated and encased, to enter sheath 43 outside the tank. The outlet condenser tubing 34 emerges from sheath 43 outside the tank and extends back up the outside of the tank to the evaporator 28. Sheath 43 terminates outside bolt plate 51 and the inter-space termini are fragilely sealed. FIG. 4 shows the arrangement wherein there are six runs of my sheathed condenser tubing comprised in my heating unit 52 and it can be inserted through a port in the nature of 3.5 inches in diameter.

Figure 5:
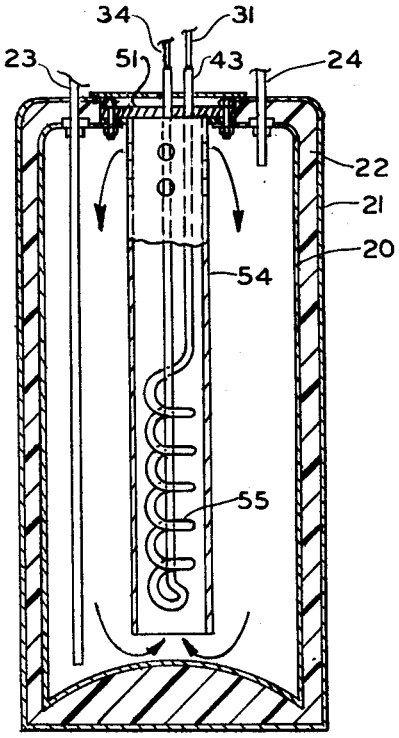
FIG. 5 is a vertical cross-sectional view of another form of the invention for use as the heat source in newly manufactured water heaters.
Figure 6:
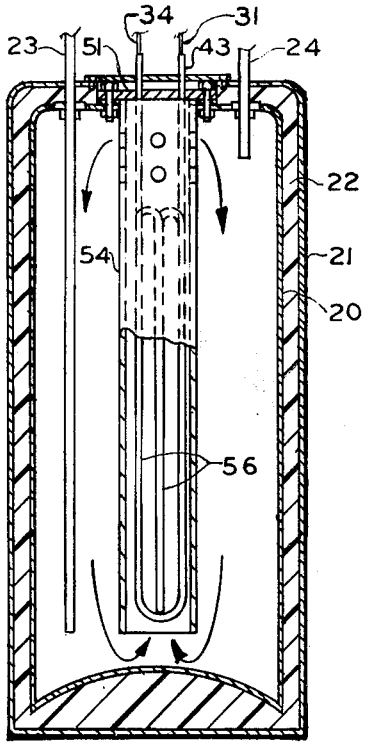
FIG. 6 is a vertical cross-sectional view of still another form of the invention for use as the heat source in newly manufactured water heaters.

FIGS. 5 and 6 show embodiments of my invention wherein the single condenser tube and sheath are used in continuous run from entry to outlet and is within a cylindrical convection conduit 54. The convection conduit 54 is in the nature of 3.5 inches in diameter and is attached to bolt plate 51 to which sheath 43 is soldered or brazed. The closure means, comprising the bolt plate 51 cooperating with a gasket and threaded studs on the tank, is similar to that described in FIGS. 2 and 3, with sheath 43 terminating outside bolt plate 51 and the inter-space termini are left open or fragilely sealed. In this arrangement, the convection conduit 54 is pierced with holes or slots in its upper portion proximate its attachment to bolt plate 51 and in the nature of 12 inches therebelow in order to provide escape of the hot convection currents from convection conduit 54. The lower end of convection conduit 54 is open and terminates proximate the bottom of the tank, in the nature of the same distance above the bottom of the tank as the terminus of the cold water inlet 23. In the alternative, the convection conduit 54 may be attached to the bottom of the tank, pierced in its lower portion, and open at its upper terminus proximate the top of the tank. However, I prefer the first described arrangement, since it comprises a unitized assembly for insertion through the port and closure thereof. In FIG. 5, the heating unit is comprised in a helical coil 55 of sheathed condenser tubing positioned within and proximately above the lower terminus of convection conduit 54. In this embodiment, I use a straight return of the continuous sheathed condenser tubing from the lower end of helical coil 55 upward to exit through bolt plate 51.

In FIG. 6, the heating unit 56 is comprised in straight runs, bends, and returns of the continuous sheathed condenser tubing within convection conduit 54. Heating unit 56 is similar to but longer than the heating unit 52 shown in FIG. 3 but, since heating unit 56 is much longer, it need not, but may, have as many runs and returns as heating unit 52. Also, the radial fins 53 which are attached to heating unit 52 are not used with heating unit 56 because they would be horizontal and would impede convection.

Figure 7:
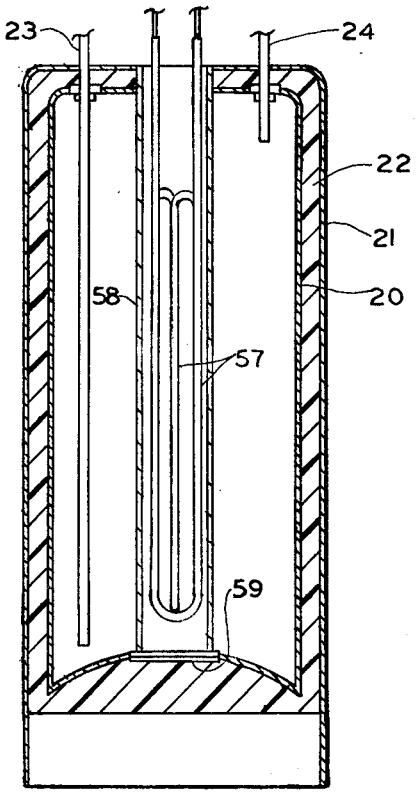
FIG. 7 is a vertical cross-sectional view of a form of the invention for use as the heat source in the conversion of an existing gas water heater.

FIG. 7 shows an embodiment of my invention for conversion of gas flame water heaters. I use a heating unit 57 which is very similar to the heating unit 56 shown in FIG. 6 and insert it downwardly into existing internal flue 58 after removing the external flue (not shown) and removing the gas flame burner (not show) from beneath the tank and sealing the lower orifice of internal flue 58 with a plate or plug 59. The internal flue 58 is then filled with powdered, particulate, or liquid thermal conductive material and the upper terminus of internal flue 58 may be left open, fragilely sealed, or firmly sealed, depending upon the amount of economic advantage sought by the conversion. That is to say, if the internal flue 58 is firmly sealed and is filled with thermal conductive material which is compatible with preservation of the potable integrity of the water in the tank, then failure of internal flue 58, as for instance through corrosion, will not destroy the economic advantage of the conversion permaturely, since I use continuously sheathed condenser tubing in heating unit 57 and the sheath would terminate outside of such firm sealing means. The final step in this conversion is to pack the space beneath the tank, previously occupied by the gas flame burner, with insulating material. In this, as in all other conversion embodiments of my invention the existing thermostat may be connected into the energy source for the compressor.

Figure 8:
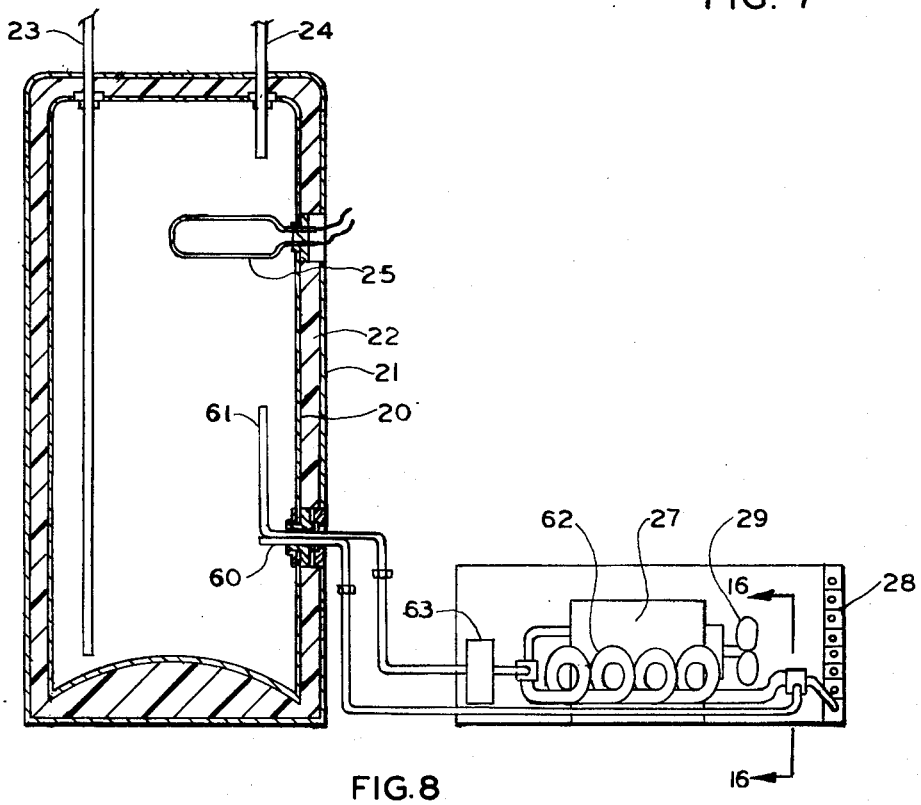
FIG. 8 is a cross-sectional view of still another form of the invention for use as the heat source in the conversion of existing electric water heaters.

In FIG. 8 is shown an embodiment of my invention which may be employed either on newly designed and manufactured water heaters or in conversion of existing water heaters of the electric or gas flame type. The embodiment depicted is in conjunction with conversion of an electric water heater and utilizes the same conventional components of a refrigeration unit, being compressor 27, evaporator 28, and fan 29. It will be understood that the refrigeration unit may be floor mounted, as shown, or top mounted on the tank. I provide an offtake tube 60, for removing cooler water from the tank for heating, and an inlet tube 61 for returning the heated water to the tank. Offtake tube 60 and inlet tube 61 are inserted into the tank through the lower heating element port after having been soldered or brazed to a beveled collar, similar to beveled collar 38 shown in FIG. 10, and the closure is completed in the same manner as shown in FIG. 10. Tubes 60 and 61 are not sheathed and tubing similar to that used for condenser tubing is satisfactory. Offtake tube 60 and inlet tube 61 are coupled to their continuation counterparts outside the tank by means of conventional flanged tube couplers for ease of insertion of the assembly comprised in tubes 60 and 61 and the beveled closure collar. The cooler water withdrawn from the tank through offtake tube 60 is conducted to a special connection near the evaporator side of my sheathed condenser tubing heating unit 62, which is in the form of a helical coil, is heated while passing through the heating coil 62 in the inter-spaces within the outer jacket thereof, exits from heating coil 62 through the same type of special connection near the compressor side of heating unit 62, passes through pump 63, and is injected back into the tank through inlet tube 61. Pump 63 is driven from the same electrical energy source as the compressor 27 and fan 29 and is also connected with the thermostat so that it does not operate unless compressor 27 is operating.

Figure 16:
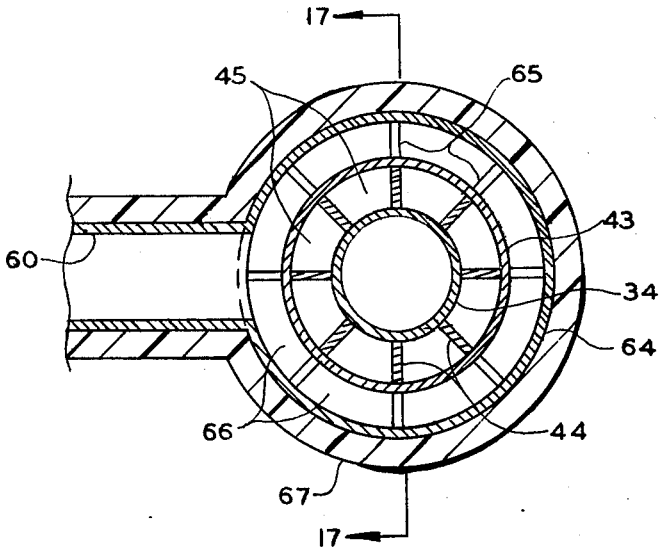
FIG. 16 is a cross-sectional view through the sheathed condenser tubing and water conductor used on the external heat source shown in FIG. 8 and taken along plane 16—16 on FIG. 8.
Figure 17:
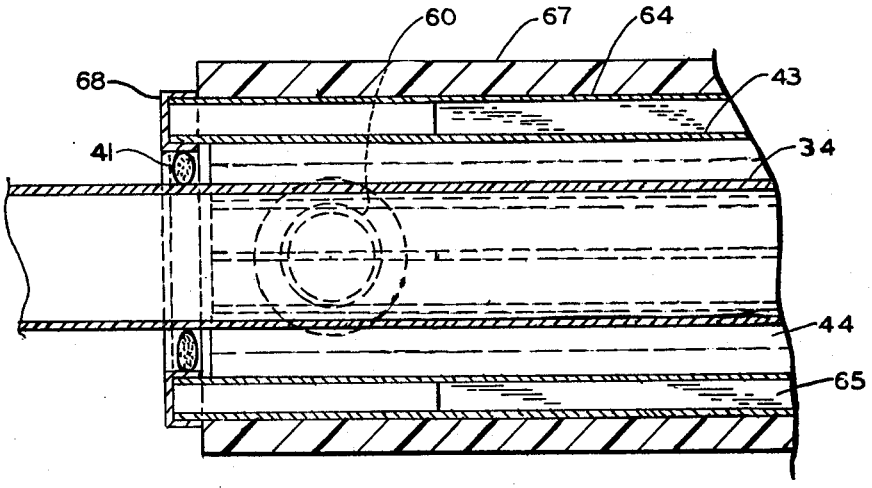
FIG. 17 is a longitudinal cross-sectional view through the end of the sheathed condenser tubing and water conductor shown in FIG. 16 and taken along plane 17—17 on FIG. 16.

FIGS. 16 and 17 show the arrangement of components for my sheathed condenser tubing heating unit 62 and the special connection for the water offtake tube 60, which connection is the same as the connection at the other end of heating unit 62 for inlet tube 61. Condenser tubing 34 is encircled in outwardly spaced relation by sheath 43 and longitudinal fins 44 engage the inside of sheath 43 and the outside of condenser tubing 34 to form longitudinal inter-spaces 45 which are filled with thermal conductive material, all of which components are the same as those shown in duplicate in FIG. 11 and described hereinbefore. In outwardly spaced relation around sheath 43, I provide water jacket tubing 64 with longitudinal fins 65 engaging the outside of sheath 43 and the inside of water jacket tubing 64, thereby creating inter-spaces 66 through which the water being heated passes. In outwardly disposed engagement with water jacket tubing 64, I provide insulating material 67 to preserve the heat imparted to the water being heated from the hot refrigerant in condenser tubing 34 and, of course, inlet tubing 61 is similarly insulated from its emergence from the heating unit 62 to its entry into the tank, for the same purpose. At the special connections at the ends of the heating unit coil 62, the condenser tubing 34 extends therebeyond, going to the evaporator 28 or coming from the compressor 27 depending upon which end of the heating unit coil 62 is being considered. Fins 65 are cut back from the ends of the water jacket tubing 64 a sufficient distance to create an annular chamber, the end of which is closed by the soldering or brazing of channel cross-section annulus 68 continuously to water jacket tubing 64 and sheath 43. To an appropriate orifice in the side of said water jacket tubing 64 in the area of said annular chamber, offtake tube 60 or inlet tube 61, depending on which end of heating unit coil 62 is being considered, is soldered or brazed. Fins 44 are cut back from the end of sheath 43 a sufficient distance to permit the fitting of annulus 68. After the inter-spaces 44 are filled with the selected thermal conductive material, the ends thereof are closed with fragilely rupturable mastic or membrane 41.

What is claimed is:

1. In conversion of the heat source in existing electric water heaters, a hot water tank from which the lower electric resistance heating element has been removed, a heating coil inserted into the said tank through the orifice from which the said lower heating element was removed, said heating coil being helical and having inlet condenser tubing externally communicating with the compressor side of a refrigerating unit to receive hot refrigerant therefrom and being continuously sheathed along its length within said tank by a sheath tube in outwardly spaced relation to said inlet condenser tubing, outlet condenser tubing externally communicating with the evaporator side of said refrigerating unit to deliver relatively cooler refrigerant thereto and being continuously sheathed along its length within said tank by a sheath tube in outwardly spaced relation to said outlet condenser tubing, sheathed return cap engaging the innermost end of the said inlet and outlet condenser tubing and the innermost end of each said sheath tube adapted to preserve inter-space between said condenser tubing and said sheath, thermal conductive material filling the inter-space between the outside of said condenser tubing and the inside of said sheath, each said sheath terminating proximately outside said tank whereat said inter-spaces are open to the atmosphere or fragilely sealed, and a closure means outwardly engaging said sheaths and adapted to close the said orifice therearound.

2. The apparatus of claim 1 wherein a plurality of longitudinal fins of the same material as the said condenser tube and the said sheath tubes engage the outer surface of said condenser tubes and the inner surface of said sheath tubes.

3. The apparatus of claim 1 wherein the said condenser tubes are sheathed by a single sheath tube in outwardly spaced relation to said condenser tubes.

4. The apparatus of claim 1 wherein each said condenser tube is helically corrugated and each said sheath tube is helically corrugated, said helical corrugation being adapted to cause engagement between the outside of the peaks of said condenser tube corrugations and the inside of the valleys of said sheath tube corrugations, thereby providing continuous helical inter-space between said condenser tube and said sheath tube.

5. The apparatus of claim 1 wherein said compressor of said refrigerating unit fixedly engages the top of said hot water tank, said engagement being adapted to impart vibration from said compressor to said hot water tank during operation of said compressor.

6. The apparatus of claim 1 wherein a variable thermostat adapted to measure the temperature of the water being heated in said hot water tank is interconnected with the electrical energy source of said compressor and adapted to control operation of said compressor.

7. In conversion of the heat source in existing gas flame water heaters, a hot water tank from which the gas flame heating unit and the external flue have been removed, sealing means fixedly engaging the lowermost disposed end of the internal flue of said hot water tank, a heating unit inserted into the uppermost disposed end of said internal flue and extending downward therein proximate the lowermost disposed end thereof, said heating unit being comprised in vertical runs and return bends of continuously sheathed condenser tubing and having an inlet side and an outlet side extending outwardly from the uppermost disposed end of said internal flue, said inlet side externally communicating with the compressor side of a refrigerating unit to receive hot refrigerant therefrom and said outlet side externally communicating with the evaporator side of said refrigerating unit to deliver relatively cooler refrigerant thereto, said continuous sheath being comprised in a sheath tube in outwardly spaced relation to said condenser tubing and terminating proximately above the uppermost disposed end of said internal flue on said inlet side and said outlet side of said condenser tubing whereat the inter-space between the outside of said condenser tubing and the inside of said sheath tube is open to the atmosphere or fragilely sealed, thermal conductive material filling the said inter-space between the outside of said condenser tubing and the inside of said sheath tube, and thermal conductive material filling the remaining space inside the said internal flue.

8. The apparatus of claim 7 wherein a plurality of longitudinal fins of the same material as said condenser tubing and said sheath tube engage the outer surface of said condenser tubing and the inner surface of said sheath tube.

9. The apparatus of claim 7 wherein said condenser tubing is helically corrugated and said sheath tube is helically corrugated, said helical corrugations being adapted to cause engagement between the outside of the peaks of said condenser tubing corrugations and the inside of the valleys of said sheath tube corrugations, thereby providing continuous helical inter-space between said condenser tubing and said sheath tube.

10. A water heater comprising a cylindrical tank for receiving water to be heated, a refrigerating unit mounted on the uppermost disposed end of said tank, an orifice substantially in the center of the uppermost disposed end of said tank adapted to receive a heating unit therethrough and to extend downward therefrom proximately to the lowermost disposed end of said tank, said heating unit being helical at its lowermost disposed end depending downwardly from said orifice and having inlet condenser tubing externally communicating with the compressor side of said refrigerating unit to receive hot refrigerant therefrom and being continuously sheathed along its length within said tank by a sheath tube in outwardly spaced relation to said inlet condenser tubing, outlet condenser tubing externally communicating with the evaporator side of said refrigerating unit to deliver relatively cooler refrigerant thereto and being continuously sheathed along its length within said tank by a sheath tube in outwardly spaced relation to said outlet condenser tubing, sheathed return cap engaging the innermost end of said inlet and outlet condenser tubing and the innermost end of each said sheath tube adapted to preserve inter-space between said condenser tubing and said sheath, thermal conductive material filling the inter-space between the outside of said condenser tubing and the inside of said sheath, each said sheath terminating proximately outside said tank whereat said inter-spaces are open to the atmosphere or fragilely sealed, a closure means outwardly engaging said sheaths and adapted to close the said orifice therearound, and a variable thermostat adapted to measure the temperature of the water being heated in said tank interconnected with the electrical energy source of said compressor and adapted to control operation of said compressor.

11. The apparatus of claim 10 wherein a plurality of longitudinal fins of the same material as said condenser tubes and said sheath tubes engage the outer surface of said condenser tubes and the inner surface of said sheath tubes.

12. The apparatus of claim 10 wherein the said condenser tubes are sheathed by a single sheath tube in outwardly spaced relation to said condenser tubes.

13. The apparatus of claim 10 wherein each said condenser tube is helically corrugated and each said sheath tube is helically corrugated, said helical corrugations being adapted to cause engagement between the outside of the peaks of said condenser tube corrugations and the inside of the valleys of said sheath tube corrugations, thereby providing continuous helical inter-space between said condenser tube and said sheath tube.

14. A water heater comprising a cylindrical tank for receiving water to be heated, a refrigerating unit mounted on the uppermost disposed end of said tank, an orifice in the side wall of said tank proximately above its lowermost disposed end adapted to receive a heating unit therethrough and to extend diametrically therefrom proximately to the oppositely disposed side wall of said tank, said heating unit being comprised in horizontal runs and return bends of continuously sheathed condenser tubing and having an inlet side and an outlet side extending outwardly from said orifice, said inlet side externally communicating with the compressor side of said refrigerating unit to receive hot refrigerant therefrom and said outlet side communicating with the evaporator side of said refrigerating unit to deliver relatively cooler refrigerant thereto, said continouous sheath being comprised in a sheath tube in outwardly spaced relation to said condenser tubing and terminating proximately outside said orifice on said inlet side and said outlet side whereat the inter-space between the outside of said condenser tubing and the inside of said sheath tube is fragilely sealed, thermal conductive material filling the said inter-space between the outside of said condenser tubing and the inside of said sheath tube, radial foil-like fins engaging the outside surface of said sheath tube along said horizontal runs within said tank, a closure means outwardly engaging said sheaths and adapted to close the said orifice therearound, and a variable thermostat adapted to measure the temperature of the water being heated in said tank interconnected with the electrical energy source of said compressor and adapted to control operation of said compressor.

15. The apparatus of claim 14 wherein a plurality of longitudinal fins of the same material as said condenser tubing and said sheath tube engage the outer surface of said condenser tubing and the inner surface of said sheath tube.

16. The apparatus of claim 10 wherein the heating unit is comprised in vertical runs and return bends of continuously sheathed condenser tubing extending downardly from said closure means proximate the lowermost disposed end of said tank and in inwardly spaced relation to a cylindrical convection conduit depending downward from said closure means proximate the lowermost disposed end of said tank and having its lowermost disposed end open to admit convection currents of the water to be heated therein and its uppermost disposed end slotted or pierced proximate the said closure means for release of said convection currents of the water heated therein.

17. The apparatus of claim 16 wherein the heating unit is comprised in continuously sheathed condenser tubing extending downwardly from said closure means and being formed into a helical coil proximate its lowermost disposed end within said convection conduit and returning upwardly from the lowermost disposed end of said helical coil to and through said closure means.

18. A water heater comprising a cylindrical tank for receiving water to be heated, a refrigerating unit, an orifice in the side wall of said tank proximately above its lowermost disposed end adapted to receive an offtake tube for withdrawing water from said tank to be heated and an input tube for reintroducing heated water into said tank, a heating unit formed in a helical coil and having condenser tubing communicating at its inlet end with the compressor side of said refrigerating unit to receive hot refrigerant therefrom and at its outlet end with the evaporator side of said refrigerating unit to deliver relatively cooler refrigerant thereto, a sheath tube in outwardly spaced relation to said condenser tubing, a water jeacket tube in outwardly spaced relation to said sheath tube providing interspace therebetween wherein the water is heated, and inlet and outlet annulus at each oppositely disposed end of said water jacket tube respectively communicating with said offtake tube and said input tube thermal conductive material filling the inter-space between the outside of said condenser tubing and the inside of said sheath tube, said inter-space being fragilely sealed at its oppositely disposed ends, a pump communicating with said input tube to circulate the water withdrawn from said tank through said offtake tube and said heating unit and said input tube back into the tank, a closure means outwardly engaging said offtake tube and input tube and adapted to close the said orifice therearound, and a variable thermostat adapted to measure the temperature of the water in said tank interconnected with the electrical energy source of said compressor and said pump and adapted to control operation thereof.

* * * * *